United States Patent [19]

Bulanchuk

[11] 4,010,997

[45] Mar. 8, 1977

[54] PLUG-IN JACK FOR ELECTRICAL BUSWAYS

[75] Inventor: William J. Bulanchuk, Pelham, N.Y.

[73] Assignee: Midland-Ross Corporation, Cleveland, Ohio

[22] Filed: Nov. 28, 1975

[21] Appl. No.: 636,040

[52] U.S. Cl. ..... 339/75 R; 339/22 B; 339/88 R

[51] Int. Cl.[2] ..... H01R 7/28; H01R 13/54

[58] Field of Search ..... 339/21 R, 22 R, 22 B, 339/75 R, 88 R

[56] References Cited

UNITED STATES PATENTS 3,611,252 10/1971 Fremont ..... 339/22 B X

FOREIGN PATENTS OR APPLICATIONS 1,220,077 1/1960 France ..... 339/22 B

*Primary Examiner*—Gerald A. Dost
*Assistant Examiner*—E. F. Desmond
*Attorney, Agent, or Firm*—H. Duane Switzer

[57] ABSTRACT

A plug-in jack for electrical busways or the like comprises a generally T-shaped housing of electrical insulating material including an enlarged head portion having a top end and a width substantially greater than its thickness. A plurality of spaced-apart electrical contact buttons extend outwardly from the top end of the head. The housing includes a base portion opposite from the head portion and having attaching means thereon for attaching the base portion to a junction box or the like. The base portion is integrally formed and connected with a relatively narrow neck portion which is integrally formed and connected with the head portion. Releasable locking means is carried by the housing intermediate the head and base portions for releasably locking the head portion in an opening. The housing is formed in two housing parts which are joined together along a joining line.

17 Claims, 15 Drawing Figures

PLUG-IN JACK FOR ELECTRICAL BUSWAYS

BACKGROUND OF THE INVENTION

This application pertains to the art of electrical connectors and, more particularly, to plug-in jacks for electrical busways or the like.

Electrical busway systems include the type where an enclosure surrounds a plurality of electrical busbars, and a downwardly facing slot in the enclosure provides access to the busbars for a plug-in jack. Plug-in jacks for busways fo this typecommonly include a head portion connected with a base portion by a relatively narrow neck portion. The head portion has a narrow dimension for reception of the head portion through the slot in the busway enclosure until the neck portion extends through the slot. The plug-in jack is then rotated 90 degrees for engaging electrical contact buttons carried by the head portion with busbars in the enclosure and releasably locking the plug-in jack in its operating position. In previous arrangements, the base portion and the neck portion were of metal, and a metal carrier portion integral with the neck portion carried a block of electrical insulating material having the electrical contact buttons mounted therein. Locking means for holding the plug-in jack in its operating position frequently comprise bullet catches mounted on the base portion on opposite sides of the neck portion.

Previous plug-in jacks of the type described have been quite expensive due to the metal casting forming the base portion, the neck portion and carrier portion, and also due to the fact that assembly of a contact button carrier to the carrier portion of the metal casting was required, along with assembly of the bullet catches to the base portion.

It would be desirable to have a plug-in jack which would be much less expensive than prior arrangements, both from a material and assembly standpoint.

SUMMARY OF THE INVENTION

A plug-in jack for electrical busways or the like includes a generally T-shaped housing of electrical insulating material. The housing includes an enlarged head portion having a top end and a width substantially greater than its thickness. A plurality of spaced-apart electrical contact buttons extend outwardly from the top end of the head portion. A base portion opposite from the head portion includes attaching means thereon for attaching the base portion to a junction box or the like. The base portion is integrally formed and connected with a relatively narrow neck portion which is integrally formed and connected with the head portion. Releasable locking means is carried by the housing intermediate the head and base portions for releasably locking the head portion in an operating position in an opening.

In a preferred arrangement, the locking means for locking the housing in an operating position comprises generally flat spring means, including at least one spring portion which is inclined upwardly toward the head to define an abutment portion, and is then curved downwardly to define a release lever portion.

The housing is preferably in two halves which are secured together along a joining line which also intersects the electrical contact buttons. The two housing halves include integral cooperating strain relief means for wires extending to the buttons through the base portion.

It is a principal object of the present invention to provide an improved low cost plug-in jack for electrical busways or the like.

It is also an object of the invention to provide an improved locking means for locking a plug-in jack in an operating position.

It is a further object of the invention to provide a plug-in jack with polarizing means so that a junction box connected with the jack faces in one direction only.

DESCRIPTION OF A PREFERRED EMBODIMENT

Figure 1:
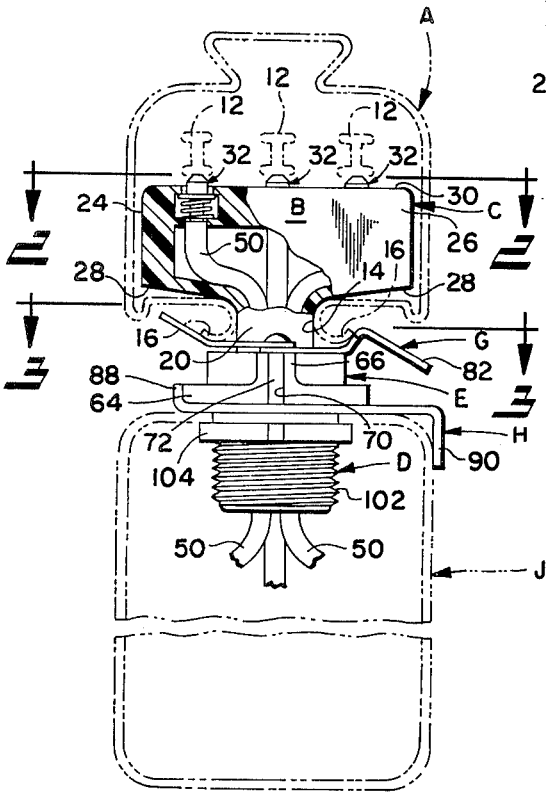
FIG. 1 is an elevational view of a plug-in jack mounted in an electrical busway, and with portions cut away for clarity of illustration.

FIG. 1 shows a trolley busway system including a metal enclosure A also known as a track or housing in which a plurality of elongated spaced-apart electrical busbars 12 are mounted in a known manner. Enclosure A has a downwardly opening bottom slot 14, and is bent downwardly and outwardly as at 16 on opposite sides of slot 14 to define what may be called stiffening portions. Trolleys are positionable within enclosure A with rollers engaging the inner surfaces of the enclosure on opposite sides of slot 14, and with rollers or brushes engaging busbars 12 for conducting electricity to equipment. For many purposes, the mobility of trolleys is unnecessary or undesirable, and plug-in jacks are used to provide stationary power take-off points.

A plug-in jack constructed in accordance with the present application includes a housing B of any suitable electrical insulating material such as synthetic plastic and being generally T-shaped in a side elevational view. Housing B has an enlarged head portion C and a base portion D opposite from head portion C. Base portion D is integrally formed and connected with a relatively narrow central neck portion 20 which is also integrally formed and connected with head portion C. In the preferred arrangement, a shoulder portion E is also integral with housing B between neck portion 20 and base portion D. For certain purposes, shoulder portion E may be considered a part of base portion D.

Enlarged head C has opposite end walls 24, opposite sidewalls 26, bottom walls 28 on opposite sides of neck portion 20 facing downwardly generally toward base portion D, and a top wall or top end 30 having a plurality of spaced-apart electrical contact buttons 32 spaced-apart therealong between end walls 24.

Figure 4:
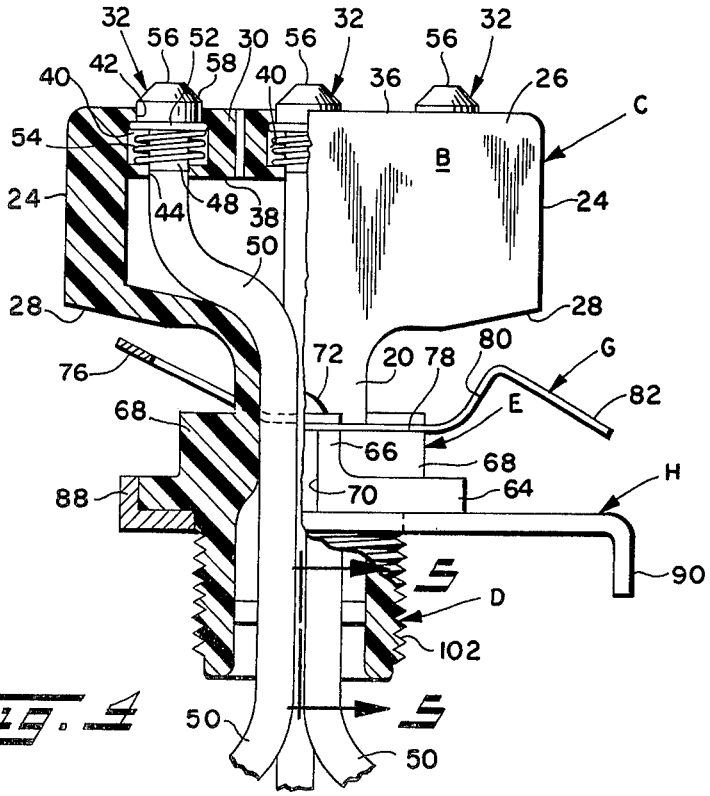
FIG. 4 is an enlarged side elevational view of the plug-in jack, and with portions cut away for clarity of illustration.

As best shown in FIG. 4, top wall 30 of enlarged head C has an outer surface 36 and an inner surface 38 between which large cavities 40 are formed. Cavities 40 are generally cylindrical in shape, and have smaller centrally located upper openings 42 communicating therebetween and outer surfaces 36, and small centrally located lower openings 44 communicating therebetween and inner surface 38.

Each metal electrical contact button 32 has a hollow sleeve portion 48 which is crimped onto the terminal end portion of a wire 50 and an outwardly extending flange 52 located within cavity 40. A coil spring 54 surrounds each sleeve 48 between the bottom of cavity 40 and flange 52. Buttons 32 have flat outer ends 56 and sloping portions 58 which slope inwardly toward flat outer ends 56 from generally cylindrical portions 60 and from top wall 30. Sleeve portion 48 is freely movable through lower opening 44, as is cylindrical portion 60 movable through upper opening 42. This arrangement allows buttons 32 to retract so that outer flat ends 56 thereof can move closer to outer surface 36 of top wall 30 while coil springs 54 maintain a firm outward bias on the buttons. Spring 54 may be considered yieldable biasing means for yieldably biasing electrical contact buttons 32 outwardly of enlarged head C.

Enlarged head C has a width across end walls 24 which is substantially greater than its thickness across sidewalls 26. The thickness of enlarged head C across sidewalls 26 is slightly less than the width of slot 14 so that housing B can be located 90° from the operating position shown in FIG. 1 for inserting enlarged head C upwardly through slot 14 until neck portion 20 is received in slot 14. Housing B is then rotated about its longitudinal axis 90° to the operating position shown in FIG. 1 wherein contact buttons 32 firmly engage busbars 12 and the width dimension of head portion C across end walls 24 extends generally perpendicular to the longitudinal axis of slot 14.

Shoulder portion E includes a generally rectangular portion 64 having central lugs 66 upstanding therefrom on opposite sides of neck portion 20. Integral joining portions 68 also upstand from the generally rectangular plate portion 64. Lugs 66 and rectangular plate portion 64 have a longitudinal slot 70 therein for receiving a metal rivet 72 which secures together releasable metal locking means G and metal polarizing plate H.

Releasable locking means G includes a generally leaf-type flat and U-shaped metal spring member 76 which is inclined upwardly from shoulder portion E toward head portion C outwardly of neck portion 20. Releasable spring means G also includes another generally leaf-type flat and U-shaped metal spring member 78 which is more sharply inclined upwardly at 80 toward head portion C in outwardly spaced relationship to neck portion 20 for defining an abutment portion. Spring member 78 is then bent downwardly to define a release lever portion 82. Spring members 76 and 78 have suitable holes therethrough for receiving rivets 72. For purposes of description, spring member 78 may be called a first spring member, while spring member 76 may be called a second spring member.

Figure 2:
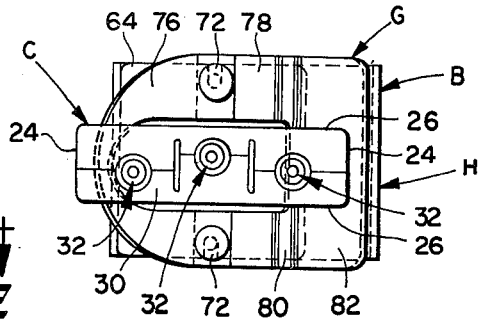
FIG. 2 is a top plan view taken generally on line 2—2 of FIG. 1.

A generally rectangular metal polarizing plate H has an upwardly extending rear flange 88 and a downwardly extending front flange 90. A suitable hole is provided through metal polarizing plate H for receiving base portion D so that upwardly extending rear flange 88 may closely abut the rear edge of rectangular plate portion 64. Polarizing plate H has suitable holes therethrough receiving metal rivets 72 so that rivets 72 define fasteners which electrically connect spring means G and polarizing means H. Base portion D of housing B includes external threads 102 for receiving an internally threaded nut 104 as shown in FIG. 2 after base portion D has been received through a hole in a junction box or the like shown at J. Threads 102 define attaching means on base portion D for attaching a junction box or the like thereto. Polarizing means H has front downwardly extending flange 90 engageable with a side portion of junction box J so that junction box J can face in only one direction. The firm engagement between metal polarizing means H and junction box J when nut 104 is tightened provides a ground through metal rivets 72 and metal spring means G to metal enclosure A.

Figure 3:
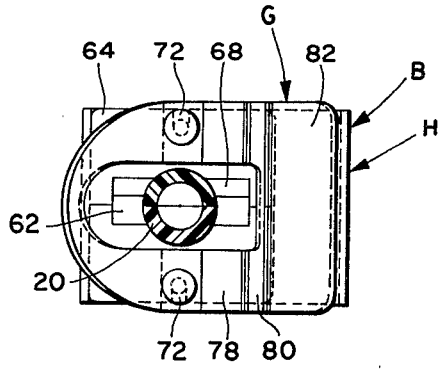
FIG. 3 is a cross-sectional plan view taken generally on line 3—3 of FIG. 1.

Once the plug-in jack is in its operating position shown in FIG. 1, abutment means 80 of FIG. 4 is engaging one downwardly and outwardly curved portion 16, while other spring member 76 is firmly biasing against the other downwardly and outwardly bent portion 16. This firmly releasably locks the plug-in jack in its operating position. Manual downward force applied on release lever portion 82 will free abutment portion 80 from engagement with its downwardly and outwardly bent portion 16 so that the plug-in jack can be rotated 90° and removed from enclosure A. Spring means G is substantially wider than the thickness of head portion C and the width of slot 14, and also substantially wider than the cross-sectional size of neck portion 20, as shown in FIGS. 2 and 3. This arrangement minimizes any interference with spring means G in rotating the plug-in jack to its operating position once enlarged head portion C has been located inside of enclosure A.

Figure 5:
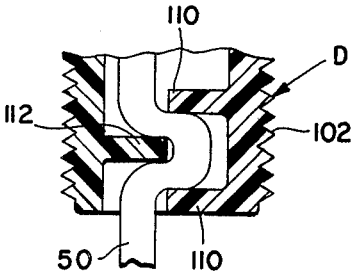
FIG. 5 is a cross-sectional elevational view taken generally on line 5—5 of FIG. 4.
Figure 10:
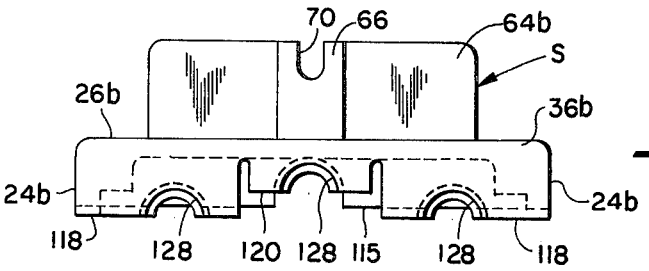
FIG. 10 is a top plan view taken generally on line 10—10 of FIG. 6.

Housing B is actually formed in two housing parts to form a hollow housing B through which wires 50 extend from base portion D to connection with contact buttons 32. Strain relief means is provided on the housing by arranging a pair of vertically spaced-apart radially inwardly extending flanges 110 on one housing part within base portion D, and an inwardly extending flange 112 on the other housing part located intermediate flanges 110. When the housing parts are secured together, each wire 50 is bent into a generally U-shaped configuration between flanges 110 and 112, and is also squeezed somewhat between the flanges as shown in FIG. 5 so that a strain relief is provided to prevent breaking the connecting between a button 32 and a wire 50 when a wire 50 is pulled upon from outside of the housing.

FIGS. 6–15 show two different housing parts P and S which cooperate with one another when joined together to form housing B of FIGS. 1–5. One housing part P of FIGS. 11–15 has been given numerals followed by the letter *a* so that corresponding parts and surfaces of housing B can be identified with respect to housing part P. Likewise, portions and surfaces of housing part S have been identified using numerals followed by the letter *b*. By way of example, each housing part P and S includes a base portion having one-half of an external thread 102*a* or 102*b* thereon which cooperate with one another when the two housing parts are joined together in order to form the complete exterior thread 102 on housing B of FIGS. 1–5. Other surfaces and portions on the two housing parts likewise cooperate with one another in the same manner.

Figure 9:
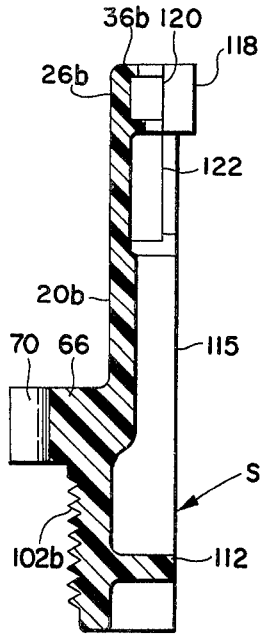
FIG. 9 is a cross-sectional elevational view taken generally on line 9—9 of FIG. 6.
Figure 6:
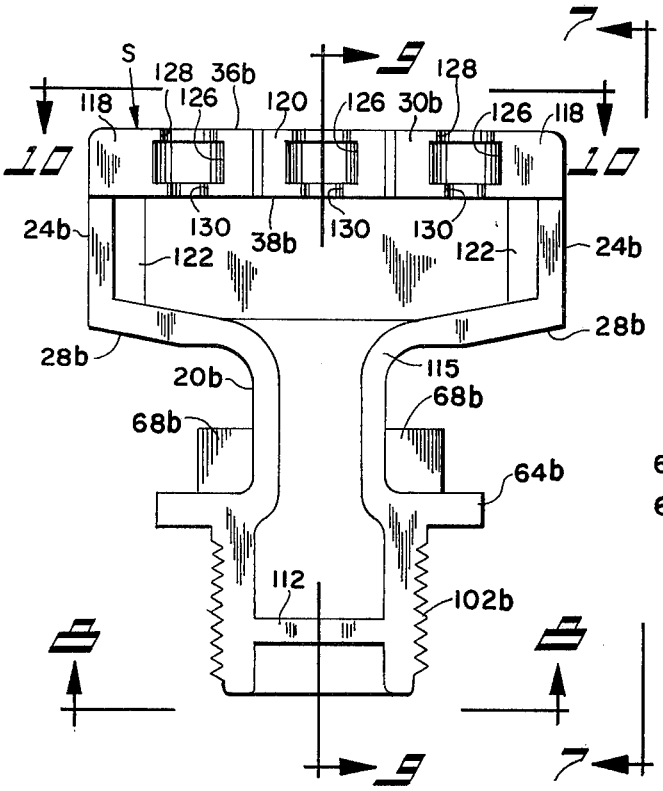
FIG. 6 is an elevational view showing the inside of one housing part used to form a complete housing.
Figure 7:
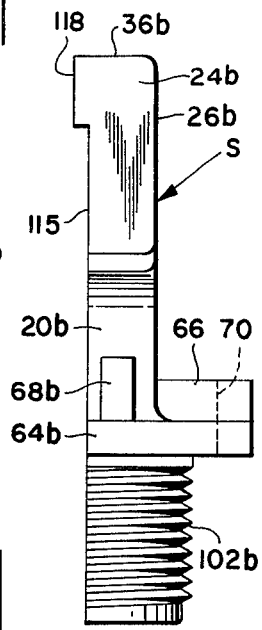
FIG. 7 is an end elevational view taken generally on line 7—7 of FIG. 6.
Figure 8:
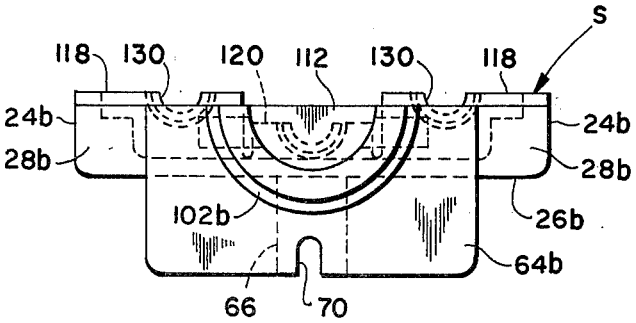
FIG. 8 is a bottom view taken generally on line 8—8 of FIG. 6.
Figure 14:
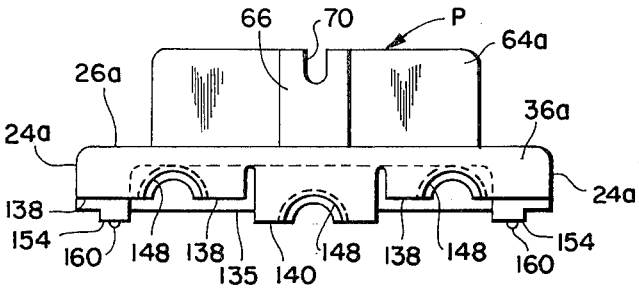
FIG. 14 is a top plan view taken generally on line 14—14 of FIG. 11.

The two housing parts are joined together generally along a vertical plane extending generally parallel to side surfaces 26 of housing B in FIG. 2 and bisecting the housing from base D up to top wall 30 where the joining line is staggered. With reference to housing part S of FIGS. 6–10, a flat joining surface 115 extends from the base thereof up to top wall 30*b* where the inner edge surface of top wall 30*b* has opposite side edge surface portions 118 stepped outwardly from surface 115, and an intermediate edge surface 120 stepped inwardly from surfaces 115 and 118. Joining portions 68*b* have joining surfaces spaced inwardly from joining surface 115. Housing part S has additional joining surfaces 122 in the head portion thereof spaced inwardly from joining surface 115 as shown in FIG. 9.

Each side edge portion 118 and 120 of top wall 30*b* has a large arcuate recess 126 therein intermediate outer and inner surfaces 36*b* and 38*b*. Centrally located small arcuate upper recesses 128 extend between large recesses 126 and upper surface 36*b*. Centrally located small arcuate lower recesses 130 extend between large recesses 126 and inner surface 38*b*.

Figures 11, 12, 15:
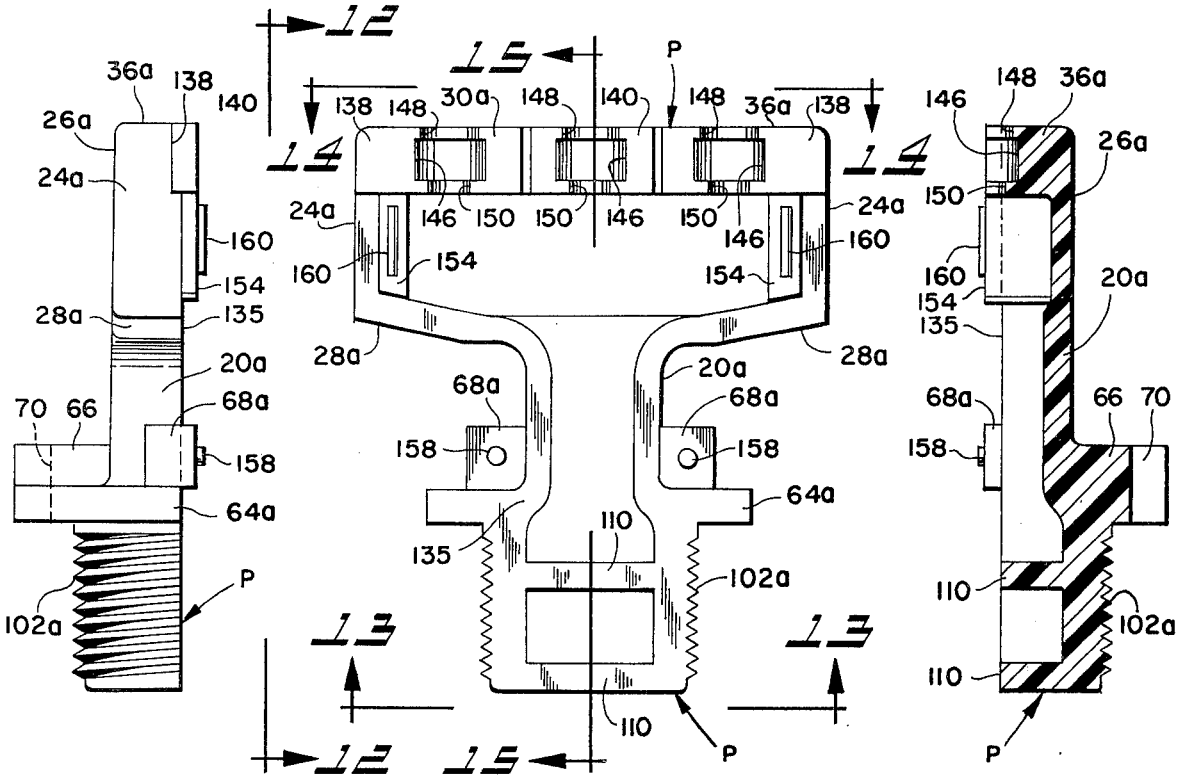
FIG. 11 is an elevational view showing the interior of the other housing part used to form the complete housing.
FIG. 12 is an end elevational view taken generally on line 12—12 of FIG. 11.
FIG. 15 is a cross-sectional elevational view taken generally on line 15—15 of FIG. 11.
Figure 13:
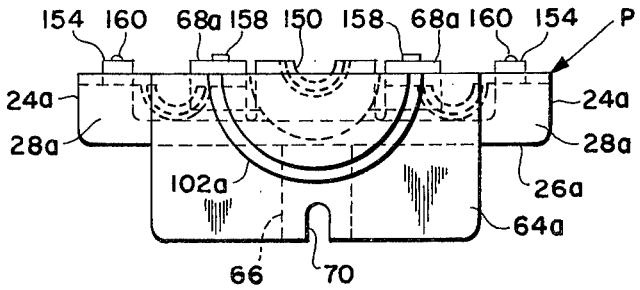
FIG. 13 is a bottom view taken generally on line 13—13 of FIG. 11.

Housing part P has a flat joining surface extending from the base thereof up to top wall 30*a* thereof. The inner side edge of top wall 30*a* has opposite side edge surfaces 138 spaced inwardly from joining surface 135, and an intermediate side edge surface 140 spaced outwardly from joining surface 135 and surfaces 138. Each side edge surface 138 and 140 has a large recess 146 located intermediate outer and inner surfaces 36*a* and 38*a*. Centrally located small upper recesses 148 extend between large recesses 146 and outer surface 36*a*. Centrally located small lower recesses 150 extend between large recesses 146 and inner surface 38*a*. Housing part P includes joining surfaces 154 in the head portion thereof projecting outwardly beyond joining surface 135. The other joining surfaces of joining portions 68*a* also extend outwardly beyond joining surface 135 as shown in FIGS. 12 and 15. The joining surfaces of elements 68*a* and 154 has slightly outwardly extending excessive material portions as at 158 on surfaces 68*a*, and at 160 on joining surfaces 154. The joining surfaces of portions 68*b* on housing part S in FIGS. 6–10 are displaced rearwardly from joining surface 115 the same distance that the joining surfaces of elements 68*a* on housing part P of FIGS. 11–15 is displaced outwardly beyond joining surface 135. The same is true for joining surfaces 122 on housing part S and joining surfaces 154 on housing part P. Likewise, surfaces 118 on housing part S extend outwardly beyond joining surface 115 substantially the same distance that surfaces 138 on housing part P are stepped inwardly from joining surface 135. Surface 140 on housing part P extends outwardly beyond joining surface 135 by substantially the same distance surface 120 of housing part S is stepped inwardly from joining surface 115. The stepped arrangement of the head portion of the housing part provides somewhat of a mechanical interlocking arrangement.

To assemble the plug-in jack, coil springs 54 are positioned over sleeve portions 48 of buttons 32 and stripped end portions of wires 50 are positioned in sleeve portions 48 whereupon such sleeve portions are crimped onto the ends of the wires. The buttons and coil springs are then positioned in the large and small recesses on one of the housing parts, with the wires extending through the interior of the hollow portion of that one housing part. The other housing part is then positioned over the one housing part having the buttons and wires therein, and the housings are ultrasonically welded together at surfaces 122 and 154, and 68*a* and 68*b*. The excess material at 158 and 160 on housing part P is for purposes of the ultrasonic welding so that this excess material melts to fuse the two housing parts together. Obviously, the housing parts could also be joined by adhesive or the like on any of the joining surfaces. Obviously, recesses 126 and 148 cooperate in the assembled housing to define cavities 40, while recesses 128 and 148 cooperate to define small upper openings 42, and recesses 130 and 150 cooperate to define lower openings 44. The joint between surfaces 118 and 138 is offset on one side of the plane in which joining surfaces 115 and 135 lie in the assembled housing, while the joint between surfaces 120 and 140 is offset on the opposite side of that plane. Spring means G and polarizing means H are then positioned on the assembled housing and rivets 72 applied for fastening the spring means and polarizing means to the housing.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A plug-in jack for electrical busways or the like comprising; a generally T-shaped hollow housing of electrical insulating material including an enlarged hollow head portion having end walls and sidewalls and a substantially closed top end, said head portion having a width across said end walls substantially greater than its thickness across said sidewalls, a plurality of spaced-apart electrical contact buttons extending outwardly from said top end of said head portion, a hollow base portion opposite from said head portion and having attaching means thereon for attaching said base portion to a junction box or the like, said base portion being integrally formed and connected with a relatively narrow hollow neck portion which is integrally formed and connected with said head portion, said head portion, neck portion and base portion having hollow interiors communicating with one another for passage of wires therethrough for connection with said buttons, and releasable locking means carried by said housing intermediate said head and base portions for releasably locking said head portion in an opening.

2. The jack of claim 1 wherein said housing is formed of two parts which are secured together and include integral cooperating strain relief means for wires extending to said buttons through said base portion, each said part extending longitudinally of said housing and forming a portion of all said head, neck and base portions.

3. The jack of claim 1 wherein said buttons have flat ends spaced outwardly from said top end of said head and outwardly facing sloping portions which slope toward said flat ends from adjacent said top end of said head.

4. The jack of claim 1 wherein said base portion includes an externally threaded terminal end portion, and an enlarged outwardly extending shoulder portion between said threaded terminal end portion and said neck portion.

5. The jack of claim 1 wherein said buttons are spaced-apart along the width of said head between said end walls and said housing is formed in two housing parts secured together along a joint extending from said head portion to said base portion and intersecting said buttons, each said housing part including a top wall having outer and inner top wall surfaces and a top wall edge surface, a plurality of spaced-apart large arcuate recesses in said top wall edge surface between said outer and inner top wall surfaces, an upper small arcuate recess in said top wall edge surface extending centrally from each said large arcuate recess to said top wall outer surface, a lower small arcuate recess in said top wall edge surface extending centrally from each said large arcuate recess to said top wall inner surface, said housing parts being joined together with said top wall edge surfaces engaging one another and with said recesses therein aligned so that said large arcuate recesses cooperate to define large cavities and said small arcuate recesses cooperate to define small upper and lower openings to said cavities, said buttons being positioned in said cavities and extending outwardly through said small upper openings.

6. The jack of claim 5 wherein said buttons have outwardly extending flanges within said cavities of larger diameter than said upper openings, and coil springs positioned in said cavities between said flanges and the bottoms of said cavities.

7. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, releasable locking means carried by said housing intermediate said head and base portions for releasably locking said head portion in an opening, and said locking means comprising generally flat spring means having a width greater than the cross-sectional size of said neck portion.

8. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, releasable locking means carried by said housing intermediate said head and base portions for releasably locking said head portion in an opening, and polarizing lock means secured to said base portion for polarizing a junction box attachable to said base portion so that the junction box faces in a predetermined direction.

9. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, said head including bottom surfaces on opposite sides of said neck portion facing generally toward said base portion, releasable locking means carried by said housing intermediate said head and base portions for releasably locking said head portion in an opening, and said locking means comprising leaf-type metal springs intermediate said bottom surfaces and said base portion.

10. The jack of claim 9 including polarizing lock means secured to said base portion in spaced relationship to said springs for polarizing a junction box attachable to said base portion, and said springs and polarizing locking means being electrically connected to one another by electrically conductive fastener means securing said springs and said polarizing lock means to said housing.

11. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, said base portion including an externally threaded terminal end portion, and an enlarged outwardly extending shoulder portion between said threaded terminal end portion and said neck portion, releasable locking means carried by said housing intermediate said head and base portions for releasably locking said head portion in an opening, and said locking means including a generally flat metal spring member secured to said shoulder adjacent said neck portion, said spring member having a locking portion extending generally outwardly and upwardly from said shoulder in outwardly spaced relationship to said neck portion.

12. The jack of claim 11 wherein said spring member has a pair of opposite locking portions on opposite sides of said neck portion, said locking portions extending outwardly and upwardly from said shoulder.

13. The jack of claim 12 wherein one of said locking portions extends ourwardly and upwardly from said shoulder at a gradual relatively shallow inclination and the other of said locking portions is sharply curved upwardly to define an abutment and then downwardly to define a release lever portion.

14. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, a hollow enclosure having a plurality of elongated spaced-apart busbars supported therein and a relatively narrow downwardly opening slot, said enclosure being bent downwardly and outwardly on opposite sides of said slot to define stiffening portions, said head portion having a thickness for free reception of said head portion through said slot and said neck having a cross-sectional size smaller than the width of said slot, said head portion being insertable within said slot with said width dimension thereof extending parallel to said slot and said housing then being rotatable to an operating position for engaging said buttons with said busbars and positioning said width dimension of said head portion generally perpendicular to said slot, and releasable locking means carried by said housing intermediate said head and base portions for engaging the exterior of said stiffening portions adjacent said slot and releasably locking said housing in said operating position.

15. The jack of claim 14 wherein said housing includes an outwardly extending shoulder between said base portion and said neck portion, said locking means including a first generally flat metal spring member secured to said shoulder and having a locking portion sharply curved upwardly to define an abutment for engaging one of said stiffening portions outwardly thereof and then being curved downwardly to define a release lever.

16.The jack of claim 15 including a second generally flat metal spring member secured to said shoulder and extending upwardly and outwardly therefrom opposite from said first generally flat metal spring member.

17. A plug-in jack for electrical busways or the like comprising; a housing of electrical insulating material including an enlarged head portion having a top end and a width substantially greater than its thickness, a plurality of spaced-apart electrical contact buttons extending outwardly from said top end of said head portion, a base portion opposite from said head portion and having attaching means thereon for attaching said base portion to a junction box or the like, said base portion being integrally formed and connected with a relatively narrow neck portion which is integrally formed and connected with said head portion, a hollow enclosure having a plurality of elongated spaced-apart busbars supported thereon and a relatively narrow downwardly opening slot, said head portion having a thickness for free reception of said head portion through said slot and said neck having a cross-sectional size smaller than the width of said slot, said head portion being insertable within said slot with said width dimension thereof extending parallel to said slot and said housing then being rotatable to an operating position for engaging said buttons with said busbars and positioning said width dimension of said head portion generally perpendicular to said slot, releasable locking means carried by said housing intermediate said head and base portions for releasably locking said head portion in an opening, said locking means in said operating position of said housing engaging the exterior of said enclosure adjacent said slot for releasably locking said housing in said operating position, said enclosure and locking means being metal, a metal polarizing plate on said base portion spaced downwardly from said locking means for engaging a junction box secured to said base portion, and said locking means and polarizing plate being secured to said housing by common electrically conductive fasteners so that a ground on a junction box secured to said base portion is completed to said enclosure through said polarizing plate, fasteners and locking means.

* * * * *